US012434345B2

(12) United States Patent
Tucker

(10) Patent No.: US 12,434,345 B2
(45) Date of Patent: Oct. 7, 2025

(54) AUTOMATED DEVICE FOR WOOD FLOOR EDGE SANDING

(71) Applicant: Robert W. Tucker, Pinson, AL (US)

(72) Inventor: Robert W. Tucker, Pinson, AL (US)

( * ) Notice: Subject to any disclaimer, the term of this patent is extended or adjusted under 35 U.S.C. 154(b) by 371 days.

(21) Appl. No.: 17/582,718

(22) Filed: Jan. 24, 2022

(65) Prior Publication Data

US 2023/0234178 A1 Jul. 27, 2023

(51) Int. Cl.

| | |
|---|---|
| ***B24B 7/18*** | (2006.01) |
| ***B24B 23/03*** | (2006.01) |
| ***B24B 23/04*** | (2006.01) |

(52) U.S. Cl.

CPC ..... *B24B 7/186* (2013.01); *B24B 23/03* (2013.01); *B24B 23/04* (2013.01)

(58) Field of Classification Search

CPC .. B24B 7/188; B24B 7/06; B24B 7/07; B24B 7/00; B24B 7/186; B24B 7/02; B24B 7/075; B24B 7/18; B24B 23/03; B24B 23/04; B24B 27/0007; B24B 41/02; B24B 41/047; B24B 41/0475; B24B 47/04; B24B 47/12

USPC ..... 451/350, 353

See application file for complete search history.

(56) References Cited

U.S. PATENT DOCUMENTS

| | | | | | |
|---|---|---|---|---|---|
| 800,962 | A * | 10/1905 | Wattles | B24B 7/188 | 451/352 |
| 819,391 | A * | 5/1906 | Wattles | B24B 7/188 | 451/352 |
| 2,201,420 | A * | 5/1940 | Zschau | B24B 7/186 | 451/344 |
| 2,368,389 | A * | 1/1945 | Von Knauf | H01F 41/074 | 29/745 |
| 2,676,438 | A * | 4/1954 | Brien | B24B 7/188 | 451/352 |
| 3,273,664 | A * | 9/1966 | Ramer | A01D 34/008 | 180/400 |
| 5,531,636 | A * | 7/1996 | Bissen | B24B 7/12 | 451/130 |
| 2010/0077648 | A1* | 4/2010 | Tucker, Jr. | A01M 31/06 | 198/799 |
| 2017/0197289 | A1* | 7/2017 | Berg | B24B 7/186 | |

OTHER PUBLICATIONS

Uptown Floors, Hardwood Flooring Edgers—Sanding Sequences, https://web.archive.org/web/20180321072122/https://www.uptownfloors.com/tools/refinishing-edgers.htm, retrieved Mar. 21, 2018. (Year: 2018).*

* cited by examiner

*Primary Examiner* — Edward F Landrum
*Assistant Examiner* — Kent N Shum

(57) ABSTRACT

An automated device for wood floor edge sanding has a chassis comprising a longitudinal slot and a motor slidably coupled to the longitudinal slot. Further, the device has a chain coupled about at least three sprockets, one sprocket coupled to a shaft of the motor such that when the motor is activated, the chain rotates about the sprockets and an edge sander coupled to the chain such that when the chain moves, the edge sander rotates ovally and it intermits travel laterally.

5 Claims, 2 Drawing Sheets

AUTOMATED DEVICE FOR WOOD FLOOR EDGE SANDING

BACKGROUND

There are manual operating techniques used for sanding floors. The manual operating techniques consist of a sequence of lapping and overlapping motion.

There are also a variety of devices and/or machines for sanding wood floors. For example, devices and/or machines may be equipped with travel mechanisms engaged to assist sanding while the operator has control of the operation.

There are robotic arm devices that may be used to sand wood floors. There are large arena-type resurface machines that may be ridden. Also, there are hand-operated machines. For example, a wood floor edge having a spinning disc output. As another example, wood floor sanders may comprise a random orbital sanding tool, which may be moved in a similar direction of the manually applied motion of operation.

An angle grinder is another resurfacing device used on metallic work surfaces and stone surfaces. The output of movement may also use a coating movement of rubbing or spray application. There is also a reciprocating device for painting, sanding, or coating.

DRAWING DESCRIPTIONS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the views.

DETAILED DESCRIPTION

An automated system for wood floor edge sanding of the present disclosure moves in a direction to control a power wood floor edge sanding tool when sanding edges of a wood floor. The motion produced by the automated system for wood floor edge sanding replicates motion commonly used in wood floor edge sanding by a trained technician.

The automated system for wood floor edge sanding of the present disclosure produces consistent output of an oval loop cycle engaging sequent transmitted travel synchronized with selectable control of velocities relative to the engaged travel sequent to a lap path, and traverses, via a slider rod that is adapted to translate an opposing guide extended in the direction of travel.

The automated system for wood floor edge sanding of the present disclosure comprises a roller chain pin. At an overlap end via the endless roller chain pin, a first articulated tool adapted to drive a plurality of sprocket wheels. Further, the automated system for wood floor edge sanding of the present disclosure comprises a lower elevation slider rod with a slider body including a second articulated tool adapted to pivot for traversing the floor in the loop motion The automated system for wood floor edge sander further comprises a guide that translates guide wheels bias along the moving edge sanding tool at a predetermined proximity along the guide per each loop cycle. The automated system for wood floor edge sanding also comprises a collision stop switch, which is a failsafe feature to impede the operation till restart.

Figure 1:
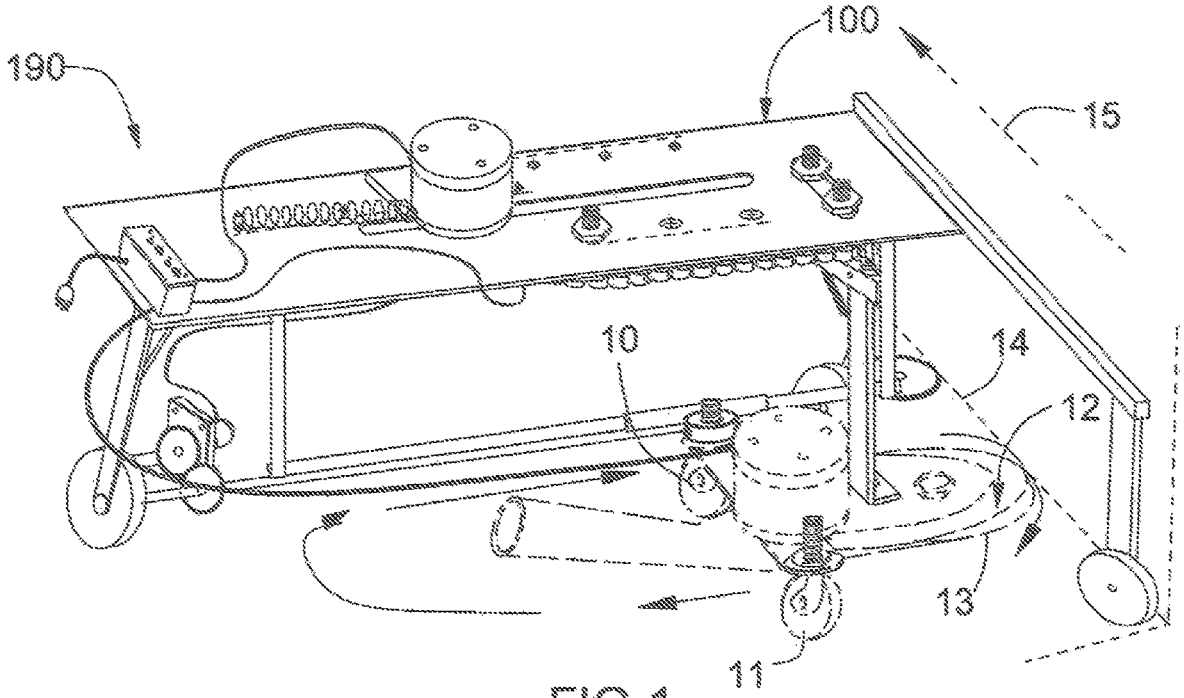
FIG. 1 is a right rear elevation view of an automated system for wood floor edge sanding in accordance with an embodiment of the present disclosure.

FIG. 1 is a right rear perspective view of the automated system for wood floor edge sanding 190. The automated system for wood floor edge sanding 190 comprises a chassis frame 100. Coupled to the chassis frame 100 is an edge sander 12. The edge sander 12 comprises two swivel wheels 10 and 11 and a disk 13. The edge sander 12 and coupled disk 13 are at a front of the automated system for wood floor edge sanding 190.

A guide 14 is illustrated with dash lines at the floor surface edge. In this regard, the guide 14 may be a wall. Arrow 15 indicates the direction of the automated system for wood floor edge sanding 190 as it moves unidirectionally along the guide 14.

Figure 2:
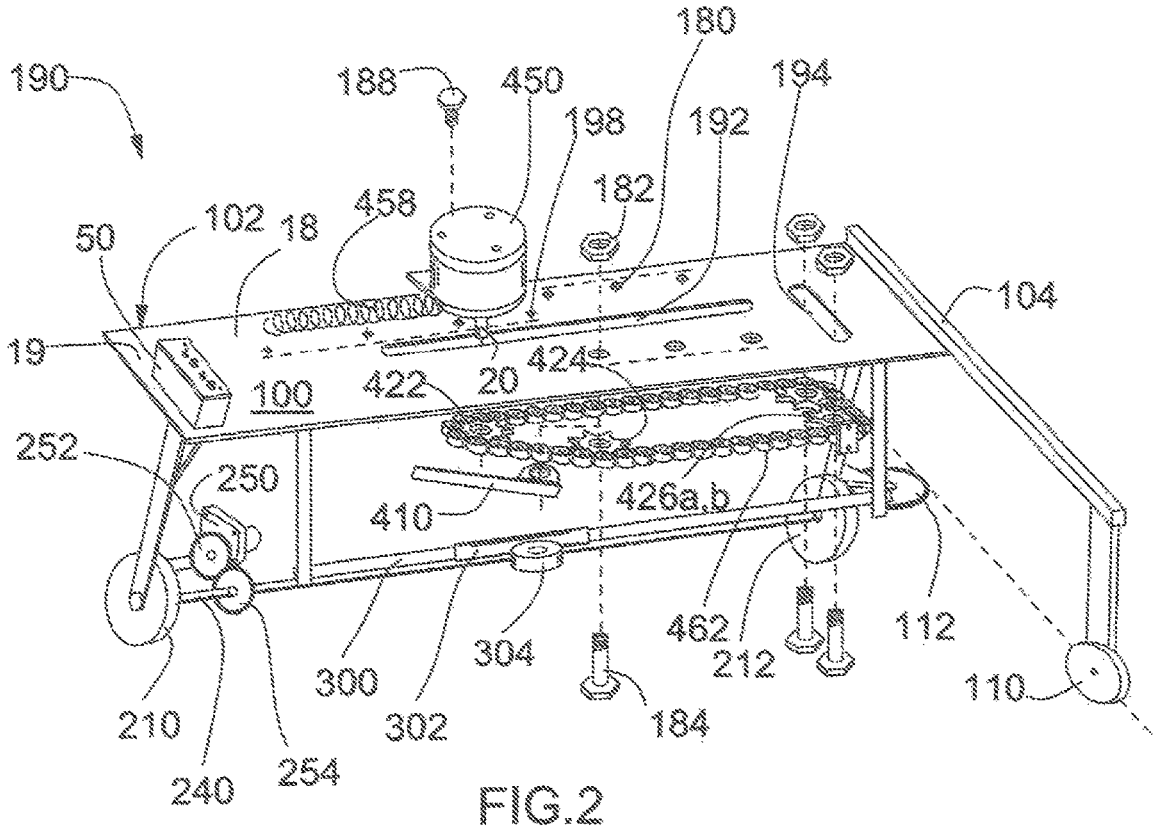
FIG. 2 is a right rear perspective view of the automated system for wood floor edge sanding such as is shown in FIG. 1.

FIG. 2 is a perspective right rear exploded elevation view of the automated system for wood floor edge sanding 190 without showing the edge sander 12. The chassis frame 100 comprises an upper platform 102. The upper platform 102 comprises an upper surface 19 and a lower-underneath surface 18.

The upper platform 102 is coupled to a motor 450. The motor 450 is coupled to and drives the drive sprocket 422 connected by a roller chain 462 to an angular deflecting sprocket 424. Further, the drive sprocket 422 is coupled via the roller chain to translating sprocket set 426*a* and 426*b*. The motor 450 comprises a tension spring 458, which relates continuous tension to the roller chain 462.

The upper platform 102 further comprises a longitudinal slot 192. The longitudinal slot 192 is elongated and widened for receiving the shaft 20. The shaft 20 of the motor 450 moves along longitudinal slot 192 relating tension and may selectively be moved in the direction of the longitudinal slot 192 elongation.

The upper platform 102 further comprises a controller 50. The controller 50 communicatively and selectively controls output.

The upper platform 102 further comprises a transmission switch 410. The transmission switch 10 is shown with a right angled dash line to share the fastener 184 below the angular deflecting sprocket 424. The transmission switch 410 engages and communicates to a transmission motor 250 for unidirectional travel.

The motor 250 and a gear 252 engages a coaxial gear 254 for driving travel engagement to coaxial rod 240. Drive wheels 210 and 212 on opposing ends of the coaxial rod 240 define a lead side.

The upper planform 102 on its translating end is in proximity with a cross slot 194. A cross frame member 104 defines a following side. A distal suspended guide wheel 112 is slanted at its base to roll along two surfaces. The slanged guide wheel 112 guide along a wall or placed guide to provide support and bias. The guide wheel 112 may be slightly curvilinear and in slight variations normal in architectural construction.

The coaxial rod 240 is not a right angle to the translating end cross frame 104. Instead, the coaxial rod 240 being steer biased to exemplify guide contiguity.

The automated system for wood floor edge sanding 190 further comprises a lower slide rail 300 and traversing slide body 302. Further, a pivot adapter 304 connects the sanding tool swivel wheel adjusting fastener stem for an oscillating shift at each end between two reciprocating paths.

The automated system for wood floor edge sanding 190 further comprises a distal horizontal guide wheel 112. The horizontal guide wheel 112 predetermined to roll along the base portion of a wall or guide equivalent.

The guide wheel 112 and slanted guide wheel 110 are affixed to chassis frame 100. There are longitudinal-linear-dash-line along three corresponding sets of perforations through the platform 102, for selective interchange, reduce the roller chain 462, thereby lessoning the loop distance.

Motor pivot mount holes 180, longitudinal slot 192, tension spring adjusting holes 198 are longitudinally placed. This allows for wood floor edge sanding having different widths of un-sanded areas. The fastener shafts 184 and a nut set 182 is contrived toan engineering standard and may include additional spacers, flat washers and locking washers (not shown).

A unidirectional arrow 15 (FIG. 1), above the translating end cross frame 104 is shown. The unidirectional travel 15 is compatible with the wood floor edge sander 12 having the spinning disk, defined as friction force urged leftwards in the travel direction. The transmission motor 250 has a gear reduction that is resistant to travel when not engaged via circuit.

Figure 3:
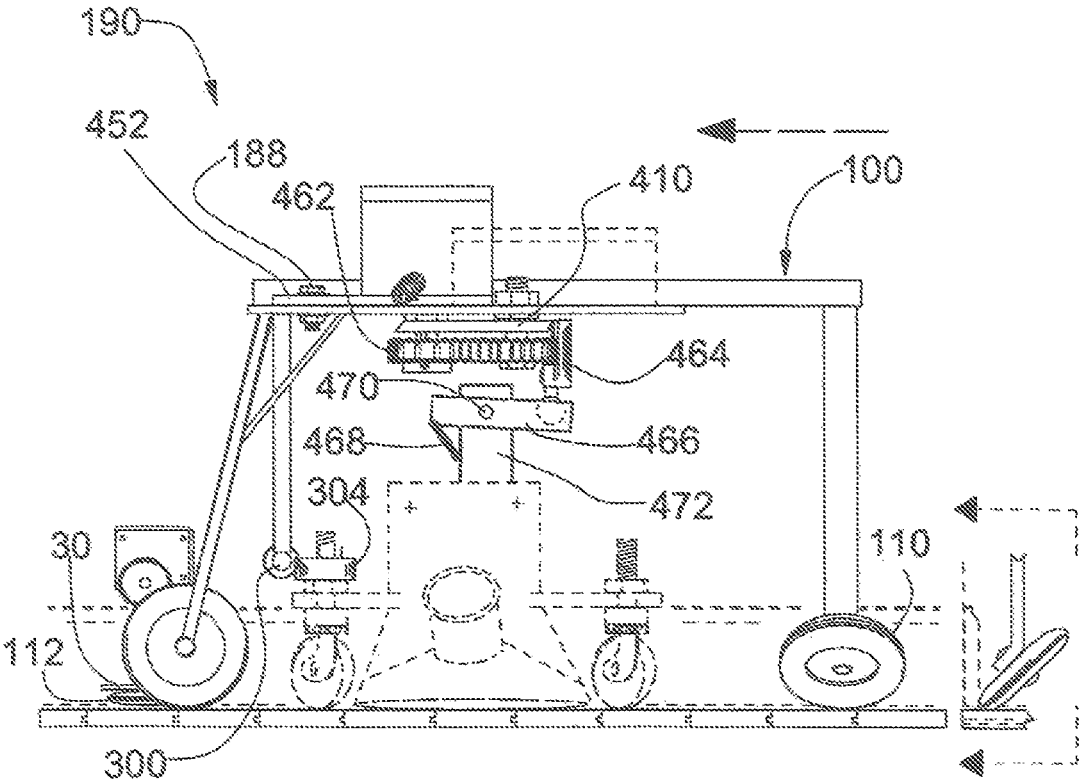
FIG. 3 is a rear elevation view of the automated system for wood floor edge sanding as is shown in FIG. 1.

FIG. 3 is a rear elevation view of the automated device for wood floor edge sanding 190, showing the chassis frame 100 in operational connection with an exemplary edge sanding tool 12. The roller chain 462 having a connecting pin 464 is suspended with a spherical articulation to a rocker arm 466. The rocker arm 466 pivot fastened by fastener 470 to an upward tool body adapter 472 having a constant pressure spring 468 pulling downward to the rocker arm 466 relating a constant upward pressure on the spherical ball portion of the pin body 464. The upward tool body adapter 472 may flex forwards and rearwards slightly if a force or resistance is applied. A reciprocation direction change per end at greater reciprocation velocity would be one example of force or resistance of a direction change and path swing.

The tool body connector 472 may be altered to a floor edge sander body, or a handle portion (not shown). The flat portion of the upward tool body connector 472 is for the rocker arm 466 having a flat receptor portion for pivot fastener 470 relating articulation.

The tool body connector is articulated resiliently to isolate much of the roller chain chatter common with chain driven devices.

A floor edge sander 12 at its nose or forward end causes frictional force that urges leftwards when in operation. The chain 462 having an applied tension exceeding the defined friction forces to minimize deflection between sprockets having extended chain portions.

A fastener pivot 188 extends through the motor base 452 and is mounted for tension for driving the roller chain 462. The pin body 464 is in a plane for engagement with the transmission switch 410, to be engaged sequent each loop cycle relating the lap path.

On the lower left side of the automated system for wood floor edge sanding 190 is the forward horizontal guide wheel 112. Just above the horizontal guide wheel 112 is collision switch 30 for automatic stop or a failsafe feature. The right lower of the automated system for wood floor edge sanding 190 is the slanted guide 110 and is affixed to bias steering slightly towards the wall or an appropriate guide selectively placed.

Figure 4:
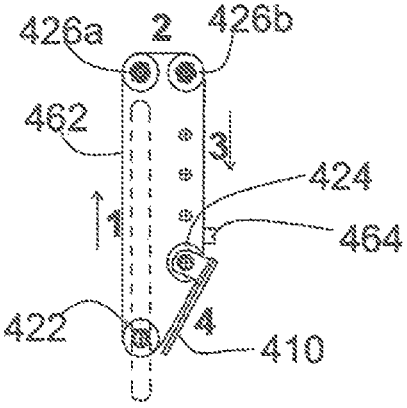
FIG. 4 is a top segment view of a loop extended of the automated system for wood floor edge sanding such as is shown in FIG. 1.

FIG. 4 is a top view of a loop extended of the automated system for wood floor edge sanding such as is shown in FIG. 1. Between each sprocket wheel are numbers 1 through 4, and these are zones of operation. Zone-1 is the lap path, zone-2 is the translating end swing to zone-3 overlap return path, and zone-4 is the momentary transmission switch 410 engaged having a longer path swing back to zone-1, which results in a lap to the un-worked path. The driven sprocket 422 within the dash line slot 192, the translating sprocket set 426*a* and 426*b*, and the angular deflecting sprocket 424 are typical of the four zone loop.

Figure 5:
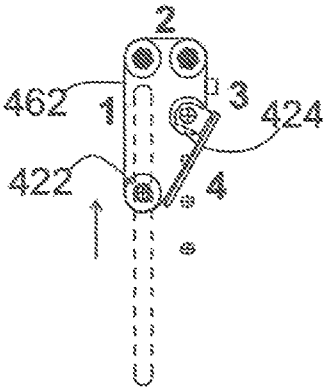
FIG. 5 is a top segment view of a loop less-extended of the automated system for wood floor edge sanding such as is shown in FIG. 1.

FIG. 5 is a top sectional view of the roller chain 462 shortened selectively by removal and reconnecting links and is looped around four sprocket wheels 422, 424, 426*a*, and 426*b* in an interchanged arrangement.

Figure 6:
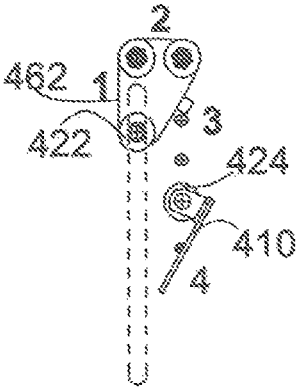
FIG. 6 is a top segment view of a loop least-extended of the automated system for wood floor edge sanding such as is shown in FIG. 1.

FIG. 6 shows three zones 1-3, and three sprocket wheels for the least recommended width specific to floor edge sanding. The zone-4 is not feasible within the arrangement to achieve the least loop operation, and the transmission is engaged constant, with no intermittence.

The angular deflecting sprocket 424 and switch 410 are outside the reduced loop. The loop 462 would be a floor edge to the portion of a wall area parallel to the wood grain in common with plank or strip wood floors.

Path swing time is lengthened along with the angular portion of zone-4 for a feathering lap and overlap, desirable for more planer work surface results, or technical term of blending. The zone-4 arrangement is common having the angular portion as defined and may be altered via a slight sprocket diameter interchange, still maintaining angular portion of the roller chain in zone-4. The velocity over all is adjustable for limited movements within the scope of the presented device, including tool profiles, and tool output characterizations.

Wheels can be in a plurality greater or lesser than is drawn, relative for travel and support. Mass of the presented device is in proportion for motion force related to the tool, and wood floor conditions. Finished wood floor surfaces have less traction reception till the finish or coating is abrasively removed. Wheels 110 and 112 may be of a plurality of resilient wheels for additional traction stability. The motor 450 may be in offset biasing to the lead side to balance mass. The motor 450 profile may gear reduce with higher motor rating increasing mass proportioned for the presented operation. The total of the presented device can be fabricated opposite hand.

What I claim is:

1. An automated device for wood floor edge sanding comprising:

a chassis frame comprising an upper platform with a longitudinal slot, two drive wheels extending below the upper flatform, and two guide wheels extending below the upper platform;

a motor slidably coupled to the longitudinal slot;

a tension spring attached to the motor and to the upper platform;

at least three sprockets rotatably coupled to the upper platform;

a driving sprocket coupled to a shaft of the motor and a chain coupled about the driving sprocket and the at least three sprockets, the driving sprocket and the at least three sprockets positioned such that the chain is configured to rotate in a plane parallel to a floor;

a tool body connector assembly comprising a connecting pin, a rocker arm pivotably attached to the connecting pin, a tool body adapter pivotably attached to the rocker arm, and a constant pressure spring connected to the rocker arm and the tool body adapter, wherein one end of the connecting pin is attached to the chain;

the chassis frame further comprising a lower slide rail, a slide body slidably attached to the lower slide rail, and a pivot adapter connected to the slide body;

an edge sander comprising a sander motor, a circular abrasive disk, and swivel wheels, wherein the sander motor is configured to rotate the circular abrasive disk;

wherein the edge sander is connected to the chassis frame by the tool body adapter and the pivot adapter; and wherein the pivot adapter, the slide body, the lower slide rail are configured to restrict the movement of the edge sander to a linear movement relative to the upper platform and parallel to the longitudinal slot.

2. The automated device for wood floor edge sanding of claim 1, wherein the rocker arm is attached to the connecting pin via a spherical articulation joint.

3. The automated device for wood floor edge sanding of claim 1, wherein the two guide wheels are slanted relative to the floor in order to bias steering of the chassis frame.

4. The automated device for wood floor edge sanding of claim 1, further comprising:

a transmission motor, a gear connected to the transmission motor, and a coaxial rod connected to the gear and the two drive wheels;

wherein the transmission motor is configured to rotate the two drive wheels to move the chassis frame relative to the floor in a direction perpendicular to the longitudinal slot.

5. The automated device for wood floor edge sanding of claim 4, wherein the motor and the transmission motor are configured for synchronized movement, causing the edge sander to move ovally relative to the floor as the chassis frame moves in a single direction relative to the floor.

* * * * *